United States Patent [19]

Mitsumori

[11] Patent Number: 4,743,808

[45] Date of Patent: May 10, 1988

[54] MULTI-LAYER ELECTROLUMINESCENT ELEMENT

[75] Inventor: Ken-ichi Mitsumori, Furukawa, Japan

[73] Assignee: Alps Electric Co., Ltd., Japan

[21] Appl. No.: 17,990

[22] Filed: Feb. 24, 1987

[30] Foreign Application Priority Data

Jun. 27, 1986 [JP] Japan ..... 61-152072

[51] Int. Cl.[4] ..... G09G 3/10; H01J 1/62

[52] U.S. Cl. ..... 315/169.3; 313/494; 313/509; 315/246; 428/917; 428/201; 428/469; 428/690; 428/698; 428/699; 428/701; 428/702

[58] Field of Search ..... 428/917, 201, 704, 688, 428/689, 690, 469, 698, 699, 701, 702; 313/498, 505, 506, 509, 494; 40/544; D18/26; 315/169.3, 246

[56] References Cited

U.S. PATENT DOCUMENTS

| | | | |
|---|---|---|---|
| 2,721,950 | 10/1955 | Piper et al. | 313/358 |
| 2,988,661 | 6/1961 | Goodman | 346/781 |
| 3,258,644 | 7/1966 | Rajchman | 313/506 |
| 4,645,970 | 2/1987 | Murphy | 313/509 |

*Primary Examiner*—Ellis P. Robinson
*Assistant Examiner*—James B. Monroe
*Attorney, Agent, or Firm*—Guy W. Shoup

[57] ABSTRACT

A multi-layer electroluminescent element so constructed that the overlapping area between a second voltage applying electrode and a transparent conductive layer is larger than the overlapping area between a first voltage applying electrode and the transparent conductive layer, a further decrease of the driving voltage is possible.

2 Claims, 4 Drawing Sheets

MULTI-LAYER ELECTROLUMINESCENT ELEMENT

FIELD OF THE INVENTION

This invention relates to a multi-layer electroluminescent element including a plurality of voltage applying electrodes at the back of an electroluminescent layer so that on application of an alternating voltage to the voltage applying electrodes, an alternating electric field is applied to the display surface of the electroluminescent layer via a transparent conductive layer forming an equal potential surface, to thereby cause the electroluminescent layer to emit light.

BACKGROUND OF THE INVENTION

One form of prior art multi-layer electroluminescent elements is shown in FIG. 4 in which a transparent electrode 2, a first insulative layer 3, an electroluminescent layer 4, a second insulative layer 5 and an opposed electrode 6 are accumulated in this order on a transparent glass substrate 1. The multi-layer electroluminescent element is configured to emit light when active ions in the electroluminescent layer 4 are energized by application of an alternating electric field of several decahertz to several kilo hertz approximately between the transparent electrode 2 and the opposed electrode 6. The multi-layer electroluminescent elements are used more and more for display of various devices.

In the prior art multi-layer electroluminescent elements, however, it is necessary to externally extend electrodes from upper and lower portions of the electroluminescent layer, and this electrode extension process is significantly complicated Along with an increased demand of electroluminescent elements for display of various devices, it is desired to improve their display resolving power. However, one of the electrode layers for extraction of electroluminescence (it is normally the electrode layer nearer to the transparent glass substrate) must be a transparent conductive layer which has the specific resistance of about $2\times10^{-4}\Omega$.cm as far as the present technical level permits. If the pattern width is decreased in the attempt to improve the display resolving power, its conductive resistance increases and fails to improve the display resolving power.

In this connection, the present inventor proposed a multi-layer electroluminescent element shown in FIGS. 5 and 6 (see Japanese patent applications 123880/1985, 132881/1985 and 123882/1985). The electroluminescent element includes a transparent conductive layer 12, an insulative layer 13, an electroluminescent layer 14, an insulative layer 15 and voltage applying electrodes 16 and 17 all accumulated in this order on a transparent glass substrate 11. The voltage applying electrodes 16 and 17 consist of at least one pair of electrodes which are not electrically connected. The voltage applying electrodes 16 and 17 overlap the transparent conductive layer 12. When an alternating voltage is applied between one pair of voltage applying electrodes 16 and 17, an electric field produced by the alternating voltage is applied between the voltage applying electrodes 16–17 and the transparent conductive layer 12 which forms an equivalent potential surface. As a result, the electroluminescent layer 14 between the voltage applying electrodes 16–17 and the transparent conductive layer 12 emits light. The light emitting portion of the electroluminescent layer 14 is shown by a hatching and designated by S in FIG. 6 where the voltage applying electrodes 16 and 17 overlap the transparent conductive layer 12.

The inventor's proposal, however, six layers excluding the transparent conductive layer 12 are interposed between the voltage applying electrodes 16 and 17. More specifically, three layers, i.e. the insulative layer 15, electroluminescent layer 14 and insulative layer 13, exist between the voltage applying electrode 16 and the transparent conductive layer 12, and three layers, i.e. the insulative layer 13, electroluminescent layer 14 and insulative layer 15 exist between the transparent conductive layer 12 and the voltage applying electrode 17. Therefore, a significantly large voltage is required between the voltage applying electrodes 16 and 17.

In this connection, the present inventor further proposed a multi-layer electroluminescent element shown in FIGS. 7 and 8 (see Japanese patent application 7014/1986). The multi-layer electroluminescent element includes a transparent conductive layer 12 provided on a transparent substrate 11, an electroluminescent layer 14 provided on a part of the transparent conductive layer 12, a first voltage applying electrode 16 provided above the electroluminescent layer 14 via an insulative layer 15, and a second voltage applying electrode 17 provided above a part of the transparent conductive layer 12 via the insulative layer 15 and not overlapping the electroluminescent layer 14. When an alternating voltage is applied between the first and second voltage applying electrodes 16 and 17, an electric field produced by the alternating voltage is applied between the first and second voltage applying electrodes 16–17 and the transparent conductive layer 12 which forms an equivalent potential surface. As a result, the hatched portion S of the electroluminescent layer 14 at which the first voltage applying electrode 16 overlaps the transparent conductive layer 12 emits light.

The multi-layer electroluminescent element requires a decreased driving voltage because the number of layers is decreased between the first and second voltage applying electrodes 16 and 17. However, the decrease of the driving voltage is still insufficient. Further, since the transparent conductive layer 12 is spaced from the second voltage applying electrode 17 by only one layer, i.e. the insulative layer 15, it causes a leak between them which often damages the element.

OBJECT OF THE INVENTION

It is therefore an object of the invention to provide an electroluminescent element including voltage applying electrodes both provided on the back surface thereof but reliably operative at a decreased driving voltage.

SUMMARY OF THE INVENTION

According to the invention, there is provided a multi-layer electroluminescent element comprising:

- a transparent conductive film provided on a transparent substrate;
- an electroluminescent layer provided directly or indirectly via an insulative layer on a part of said transparent conductive layer;
- a first voltage applying electrode provided directly or indirectly via said insulative layer on said electroluminescent layer; and
- a second voltage applying electrode provided above said transparent conductive layer via said insulative layer at a portion where said electroluminescent layer does not extend, the overlapping area between said transparent conductive layer and the second voltage applying electrode being larger than the overlapping area between the transparent conductive layer and the first voltage applying electrode.

With this arrangement, when an alternating voltage is applied between the first voltage applying electrode and the second voltage applying electrode, an electric field produced by the alternating voltage is applied between the first and second voltage applying electrodes and the transparent conductive layer forming an equivalent potential surface. As a result, the electroluminescent layer between the first volta9e applying electrode and the transparent conductive layer emits light.

According to the specific features of the invention, the first voltage applying electrode is spaced from the transparent conductive layer by the electroluminescent layer and by the insulative layer when required, and the transparent conductive layer is spaced from the second voltage applying electrode only by the insulative layer. Therefore, the number of layers is decreased between the first and second voltage applying electrodes. This enables a decrease of the driving voltage of the element.

Beside this, since the overlapping area between the transparent conductive layer and the first voltage applying electrode is larger than the overlapping area between the transparent conductive layer and the second voltage applying electrode, a further decrease of the driving voltage is possible. Additionally, since the thickness of the insulative layer between the transparent conductive layer and the second voltage applying electrode may be increased without inviting an increase of the driving voltage, a leak between the transparent conductive layer and the second voltage applying electrode is prevented to ensure a reliable operation of the element.

Furthermore, since all electrodes can be taken out from the back surface of the element, the electrode extension process is very easy.

In a more preferred embodiment of the invention, the overlapping area between the transparent conductive layer and the second voltage applying electrode is larger by 1.5 times or more than the overlapping area between the transparent conductive layer and the first voltage applying electrode. If the former overlapping area is less than 1.5 times with respect to the latter overlapping area, a sufficient effect of the invention is not obtained.

In another preferred embodiment of the invention, the ratio of the overlapping area between the transparent conductive layer and the second voltage applying electrode with respect to the overlapping area between the transparent conductive layer and the first voltage applying electrode is equal to the ratio of the thickness of the insulative layer interposed between the transparent conductive layer and the second voltage applying electrode with respect to the thickness of the insulative layer interposed between the transparent conductive layer and the first voltage applying electrode. With this arrangement, the insulative layer can be increased in thickness between the transparent conductive layer and the second voltage applying electrode to ensure a reliable operation of the element.

DETAILED DESCRIPTION

Figure 1:
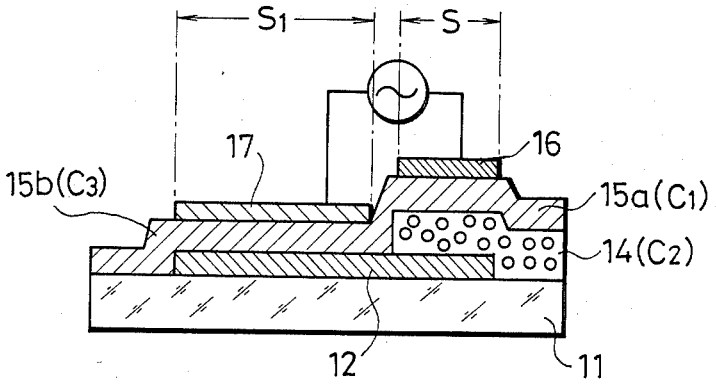
FIG. 1 is a cross-sectional view of a multi-layer electroluminescent element embodying the invention.
Figure 7:
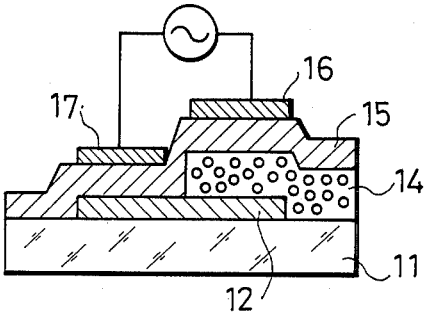
FIG. 7 is a cross-sectional view of another multi-layer electroluminescent element proposed prior to the invention.
Figure 8:
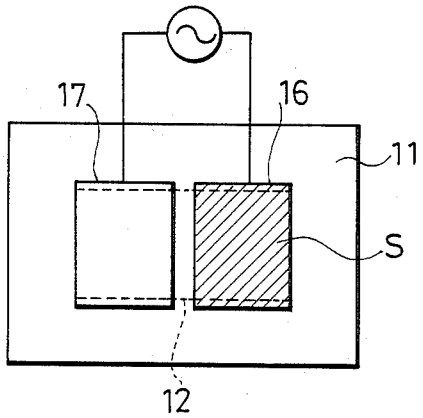
FIG. 8 is a plan view of the multi-layer electroluminescent element of FIG. 7.

FIG. 1 shows a multi-layer electroluminescent element embodying the invention. The multi-layer electroluminescent element has the same basic arrangement as that shown in FIGS. 7 and 8.

A transparent conductive layer 12 of $In_2O_3$-$S_nO_2$ material is deposited up to about 2000Å thickness on a transparent glass substrate (Corning #7059) on market by sputtering, and a pattern is formed by etching. Subsequently, an electroluminescent layer 14 made from zinc sulfide with manganese doping (ZnS:Mn, Mn=0.3 at %) is deposited up to about 6000Å thickness on the transparent conductive layer 12 by sputtering. In this case, the electroluminescent layer 14 is shaped to a pattern partly covering the transparent conductive layer 12. Further, an insulative layer made from $Ta_2O_5$ is deposited on these layers by reactive sputtering up to about 3000Å thickness. The insulative layer includes a portion 15*a* covering the electroluminescent layer 14 and another portion 15*b* directly covering the transparent conductive layer 12 where the electroluminescent layer 14 does not extend. Further, an aluminum layer for voltage applying electrodes is deposited on the insulative layers 15*a* and 15*b* by sputtering up to about 2000Å thickness. Etching is effected to the aluminum layer to form a first voltage applying electrode 16 above the electroluminescent layer 14 and a second voltage applying electrode 17 not overlapping the electroluminescent layer 14. The first and second voltage applying electrodes 16 and 17 are configured to overlap the transparent conductive layer 12 respectively.

In the illustrated embodiment, the overlapping area between the first voltage applying electrode 16 and the transparent conductive layer 12 is twice the overlapping area between the second voltage applying electrode 17 and the transparent conductive layer 12.

With this arrangement, when an alternating voltage is applied between the first voltage applying electrode 16 and the second voltage applying electrode 17, an electric field produced by the alternating voltage is applied between the first and second voltage applying electrodes 16–17 and the transparent conductive layer 12 forming an equivalent potential surface. As a result, the electroluminescent layer 14 located between the first voltage applying electrode 16 and the transparent conductive layer 12 emits light. In this case, the light is emitted from a portion of the electroluminescent layer 14 where the first voltage applying electrode 16 overlaps the transparent conductive layer 12.

In this multi-layer electroluminescent element, two layers, i.e. the insulative layer 15*a* and the electroluminescent layer 14, exist between the first voltage applying electrode 16 and the transparent conductive layer 12, and only one layer, i.e. the insulative layer 15b, exists between the transparent conductive layer 12 and the second voltage applying electrode 17. Therefore, totally 3 layers are interposed between the first and second voltage applying electrodes 16 and 17, excluding the transparent conductive layer 12.

Figure 3:
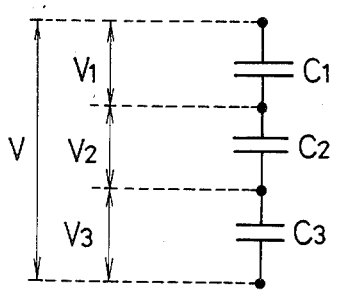
FIG. 3 is a circuit diagram of the aforegoing multi-layer electroluminescent element.
Figure 4:
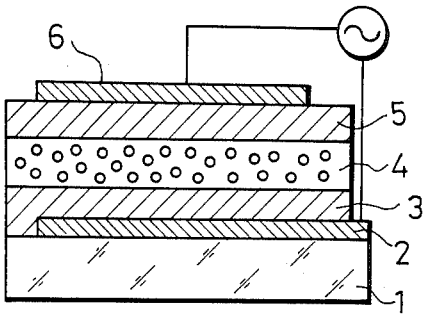
Fig. 4 PRIOR ART
FIG. 4 is a cross-sectional view of a prior art multi-layer electroluminescent element.
Figure 5:
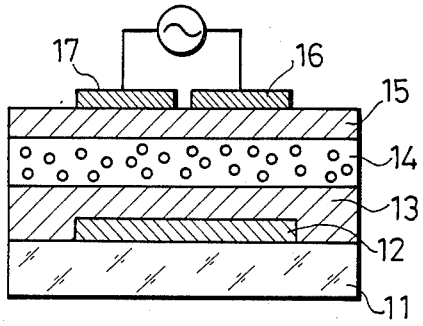
FIG. 5 is a cross-sectional view of a multi-layer electroluminescent element proposed prior to the present invention.
Figure 6:
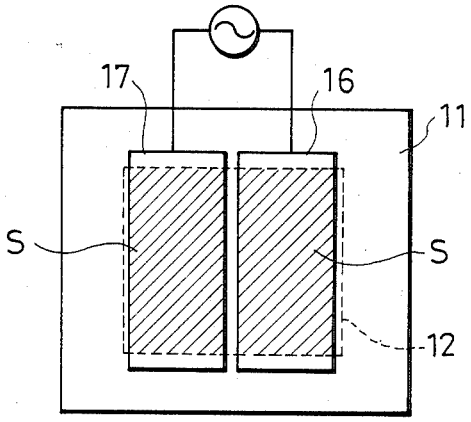
FIG. 6 is a plan view of the multi-layer electroluminescent element of FIG. 5.

Assuming that the insulative layer 15a, electroluminescent layer 14 and insulative 15b are dielectric layers respectively, a circuit diagram shown in FIG. 3 is established. In FIG. 3, $C_1$ refers to the capacitance of the insulative layer 15a, $C_2$ to the capacitance of the electroluminescent layer 14, $C_3$ to the capacitance of the insulative layer 15b, C to the sum of $C_1$, $C_2$ and $C_3$, $V_1$ to a voltage applied to the insulative layer 15a, $V_2$ to a voltage applied to the electroluminescent layer 14, $V_3$ to a voltage applied to the insulative layer 15b, V to the sum of $V_1$, $V_2$ and $V_3$, and Q to an electric charge.

From this circuit, the following equations (1) through (5) are established.

$$V=V_1+V_2+V_3\ldots \quad (1)$$

$$\frac{1}{C}=\frac{1}{C_1}+\frac{1}{C_2}+\frac{1}{C_3} \quad (2)$$

$$C=\frac{C_1C_2C_3}{C_1C_2+C_2C_3+C_3C_4} \quad (3)$$

$$V=\frac{Q}{C} \quad (4)$$

$$V_2=\frac{Q}{C_2} \quad (5)$$

From these equations, $V_2$ is expressed by:

$$V_2=\frac{C}{C_2}V \quad (6)$$

$$=\frac{C_1C_3}{C_1C_2+C_2C_3+C_3C_1}V.$$

Further, the capacitance C of a dielectric member is generally expressed by:

$$C=\frac{\epsilon\,\epsilon_0 S}{d} \quad (7)$$

In the aforegoing equations, d is the thickness of a layer, S is the area of an electrode $\epsilon_0$ is the space dielectric constant, and e is the specific dielectric constant. Therefore, expressing the thickness of the insulative layer 15a a by $d_1$, the thickness of the electroluminescent layer 14 by $d_2$, the thickness of the insulative layer 15b by $d_3$, the overlapping area between the first voltage applying electrode and the transparent conductive layer 12 by S, the overlapping area between the second voltage applying electrode and the transparent conductive layer 12 by $S_3$, the specific dielectric constant of the insulative layer 15a by $\epsilon_1$, the specific dielectric constant of the electroluminescent layer 14 by $\epsilon_2$, and the specific dielectric constant of the insulative layer 15b by $\epsilon_3$, the following equations are established:

$$C_1=\frac{\epsilon_1\,\epsilon_0 S}{d_1} \quad (8)$$

-continued $$C_2=\frac{\epsilon_2\,\epsilon_0 S}{d_2} \quad (9)$$

$$C_3=\frac{\epsilon_3\,\epsilon_0 S_3}{d_3} \quad (10)$$

As described above, since the insulative layers 15a and 15b have thicknesses $d_1$ and $d_3$ of 3000Å whereas the electroluminescent layer 14 has a thickness $d_2$ of 6000Å their relationships are expressed by $2d_1=d_2=2d_3$, $d_1=d$.

Since the insulative layers 15a and 15b are made from $Ta_2O_5$, their specific dielectric constants $\epsilon_1$ and $\epsilon_3$ are 24. Further, since the electroluminescent layer 14 is made from ZnS:Mn, its specific dielectric constant $\epsilon_2$ is 8. Therefore, their relationships are expressed by $\epsilon_1=\epsilon_3=3\epsilon_2$, $\epsilon_2=\epsilon$.

From these relationships, equations (8) through (11) may be replaced by:

$$C_1=\frac{3\,\epsilon\,\epsilon_0 S}{d} \quad (8)'$$

$$C_2=\frac{\epsilon\,\epsilon_0 S}{2d} \quad (9)'$$

$$C_3=\frac{3\epsilon\,\epsilon_0 S_3}{d} \quad (10)'$$

Combining equations (8)' through (10)' with equation (6), the following equation is obtained:

$$V_2=\frac{C_1C_3}{C_1C_2+C_2C_3+C_3C_1}V \quad (6)$$

$$=\frac{\dfrac{9\,\epsilon^2\,\epsilon_0^2SS_3}{d_2}}{\dfrac{3\,\epsilon^2\,\epsilon_0^2SS_3}{2d^2}+\dfrac{3\epsilon^2\,\epsilon_0^2SS_3}{2d^2}+\dfrac{9\,\epsilon^2\epsilon_0^2SS_3}{d^2}}$$

$$=\frac{9\,S_3}{\frac{3}{2}S+\frac{3}{2}S_3+9S_3}V$$

$$=\frac{9\,S_3}{\frac{3}{2}S+10\frac{1}{2}S_3}V \quad (11)$$

If $S=S_3$, equation (11) results in $V_2=0.75$ V. Therefore, when the overlapping area S between the first voltage applying electrode 16 and the transparent conductive layer 12 equals the overlapping area $S_3$ between the second voltage applying electrode 17 and the transparent conductive layer 12, 75% of the supplied voltage is applied to the electroluminescent layer 14.

However, if $2S=S_3$, equation (1) results in $V_2=0.8$ V. Therefore, when the overlapping area $S_3$ between the second voltage applying electrode 17 and the transparent conductive layer 12 is twice the overlapping area S between the first voltage applying electrode 16 and the transparent conductive layer 12, 80% of the supplied voltage is applied to the electroluminescent layer 14.

Figure 2:
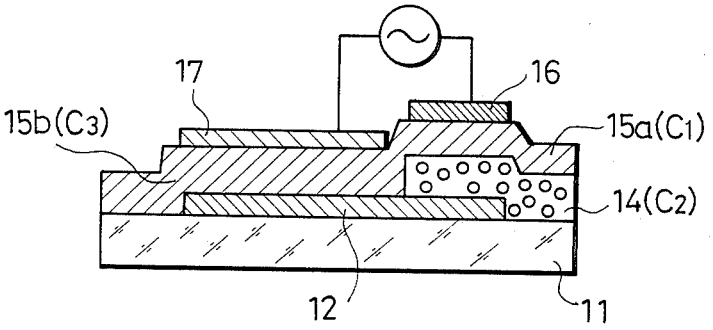
FIG. 2 is a cross-sectional view of a further embodiment of the invention.

As explained, by increasing the overlapping area $S_3$ between the second voltage applying electrode 17 and the transparent conductive layer 12, the ratio of the voltage effectively applied to the electroluminescent layer 14 can be increased to reduce the driving voltage supplied to the FIG. 2 shows a further embodiment of the invention.

This embodiment is basically equal to the embodiment of FIG. 1 except that the thickness $d_3$ of the insulative layer 15*b* interposed between the second voltage applying electrode 17 and the transparent conductive layer 12 is 6000Å which is twice the thickness of the insulative layer 15*b* in the embodiment of FIG. 1. The overlapping area $S_3$ between the second voltage applying electrode 17 and the transparent conductive layer 12 is twice the overlapping area S between the first voltage applying electrode 16 and the transparent conductive layer 12 as in the first embodiment.

In the multi-layer electroluminescent element according to the second embodiment, it is understood from equation (10) repeated below:

$$C_3 = \frac{\epsilon_3 \epsilon_0 S_3}{d_3} \quad (10)$$

that the capacitance $C_3$ does not change regardless of the double value of $d_3$ because the overlapping area $S_3$ is also twice.

Additionally, it is understood from equation (6) that the voltage ratio to the electroluminescent layer 14 does not change at a uniform value $C_3$ as far as $C_1$ and $C_2$ are equal.

Therefore, regardless of the double value of the thickness $d_3$ of the insulative layer 15*b*, light emission is performed with the same supply of driving voltage provided that the overlapping area $S_3$ between the second voltage applying electrode 16 and the transparent conductive layer 12 is twice the overlapping area S between the first voltage applying electrode 16 and the transparent conductive layer 12. Additionally, by doubling the thickness of the insulative layer 15*b*, pin holes or other undesired phenomenon of the insulative layer 15*b* are prevented. This contributes to prevention of a leak between the second voltage applying electrode 17 and the transparent conductive layer 12 and improves the reliability of the element.

As described above, according to the invention arrangement, the number of layers interposed between the first and second voltage applying electrodes to decrease the driving voltage to the element. Further, since the overlapping area between the second voltage applying electrode and the transparent conductive layer is larger than the overlapping area between the first voltage applying electrode and the transparent conductive layer, a further decrease of the driving voltage is possible. Additionally, without increasing the driving voltage, the thickness of the insulative layer interposed between the second voltage applying electrode and the transparent conductive layer is increased to prevent a leak of the insulative layer and improve the reliability of the element. Furthermore, all electrodes are configured or located to permit external extension thereof from the back surface of the element to facilitate the electrode extension or connection process. Finally, since the transparent conductive layer does not directly receive any voltage but merely serves to form an equivalent potential surface, no limitation is imposed to the pattern width, and the display resolving power is further improved.

What is claimed is:

1. A multi-layer thin film electroluminescent element comprising:

a transparent conductive film of a given area provided on a transparent substrate;

an electroluminescent layer provided directly or indirectly ia an insulative layer on said transparent conductive layer overlapping a first portion of the area of said trasnparent conductive layer;

a first voltage applying electrode provided via a first insulating layer on said electroluminescent layer;

a second voltage applying electrode provided on said transparent conductive layer via a second insulating layer overlapping a second portion of the area of said transparent conductive layer where said electroluminscent layer does not extend, the overlapping area of the second portion of said transparent conductive layer and the second voltage applying electrode being layer by a ratio of about 1.5 or more than the overlapping area of the first portion of said transparent conductive layer and the first voltage applying electrode; and an alternating voltage source for applying an alternating voltage between said first and second voltage applying electrodes in order to produce an electric field between said first and second voltage applying electrodes and said transparent conductive layer as an equivalent potential surface, whereby said electroluminescent layer emits light, a reduced driving voltage is required compared to the case where the second voltage applying electrode overlaps an area substantially equal to that of the first voltage applying electrode, and the multilayer EL element is configured to allow voltage applying leads to the electrodes to be led out from a back side of the element.

2. A multi-layer thin film electroluminscent element comprising:

a transparent conductive film of a given area provided on a transparent substrate;

an electroluminscent layer provided directly or indirectly via an insualtive layer on said transparent conductive layer overlapping a first portion of the area of said transparent conductive layer;

a first voltage applying electrode provided via a first insulating layer having a first thickness on said electroluminescent layer;

a second voltage applying electrode provided on said transparent conductive layer via a second isnulating layer having a second thickness overlapping a second portion of the area of said transparent conductive layer where said electroluminscent layer does not extend, wherein the overlapping area of the second portion of said transparent conductive layer and the second voltage applying electorde is larger than the overlapping area of the first portion of said transparent conductive layer and the first voltage applying electorde, and the ratio of the overlapping area of the second portion with respect to the overlapping area of the first portion is approximately equal to the ratio of the second thickness of the second insulating layer with respect to the first thickness of the first insulating layer; and an alternating voltage source for applying an alternating voltage between said first and second voltage applying electrodes in order to produce an electric field between said first and second voltage applying electrodes and said transparent conductive layer as an equivalent potential surface, whereby said electroluminescent layer emits light, a reduced driving voltage is required compared to the case where the second voltage applying electrode overlaps an area substantially equal to that of the first voltage applying electrode, current leakage between the second voltage applying electrode and the transparent conductive layer can be reduced, and the multi-layer EL element is configured to allow voltage applying leads to the electrodes to be led out from a back side of the element.

* * * * *